United States Patent [19]

Hoi

[11] 4,321,657

[45] Mar. 23, 1982

[54] TORCH

[75] Inventor: Cheung T. Hoi, Kowloon, Hong Kong

[73] Assignee: Freezinhot Bottle Co., Ltd., Kowloon, Hong Kong

[21] Appl. No.: 120,129

[22] Filed: Feb. 11, 1980

[30] Foreign Application Priority Data

Oct. 19, 1979 [GB] United Kingdom ..... 36282/79

[51] Int. Cl.[3] ..... F21L 7/00

[52] U.S. Cl. ..... 362/183; 362/184; 362/200; 362/228; 362/231; 362/387

[58] Field of Search ..... 362/183, 184, 200, 228, 362/231, 387

[56] References Cited

U.S. PATENT DOCUMENTS 4,218,637 8/1980 Zelina ..... 362/184

*Primary Examiner*—Stephen J. Lechert, Jr.

*Attorney, Agent, or Firm*—Oblon, Fisher, Spivak, McClelland & Maier

[57] ABSTRACT

This invention relates to torches.

The torch comprises a body defining a case for a replaceable battery, the body being formed with a handle. The torch is provided with a flashing light assembly and a fluorescent light assembly which is detachably secured to the body.

The flashing light assembly is slidably mounted in the body to either expose a flashing light or conceal the flashing light.

The fluorescent light assembly can either be attached to the body by suitable means, or detached from the body while remaining connected to the battery in the body by a lead. If desired the lead can be disconnected from the battery in the body and reconnected to an alternative power source, such as a car battery.

12 Claims, 5 Drawing Figures

TORCH

This invention relates to torches. Previous portable torches have a main body containing both the power supply and the light. This results in a large heavy torch in which the light may not be detached from the body without being disconnected from the power supply. Thus, if it is desired to inspect a fairly awkward location, or the light is required to be suspended from a fragile support, for example, both the body and the power supply have to go with the light, which creates obvious difficulties.

According to the present invention, a torch comprises a body defining a battery case, and a light fitting detachably mounted on the body and connected to it through a flexible lead so that the light may be used when on the body or when detached from the body. With this arrangement the light may remain connected to the battery but still be manoeuvrable separately from the body of the torch.

The body of the torch is preferably moulded from plastics as this is both light and strong, but it may be made out of other suitable material.

The light is mounted on the body by any suitable means such as a friction fit or a snapfit connection.

It may be desirable to have two lights, both connected to the same power supply so that while one light is operating separately from the body, the other remains attached to the torch.

In some circumstances, it may be required to use the light from an alternative power source in which case the light can be detached from the torch and a lead connected between the power supply and light may be disconnected leaving the light completely free from the torch.

The invention may be carried into practice in various ways, but one embodiment will now be described by way of example, with reference to the accompanying drawings; in which FIG. 1 is a side elevation of a torch;

Figure 1:
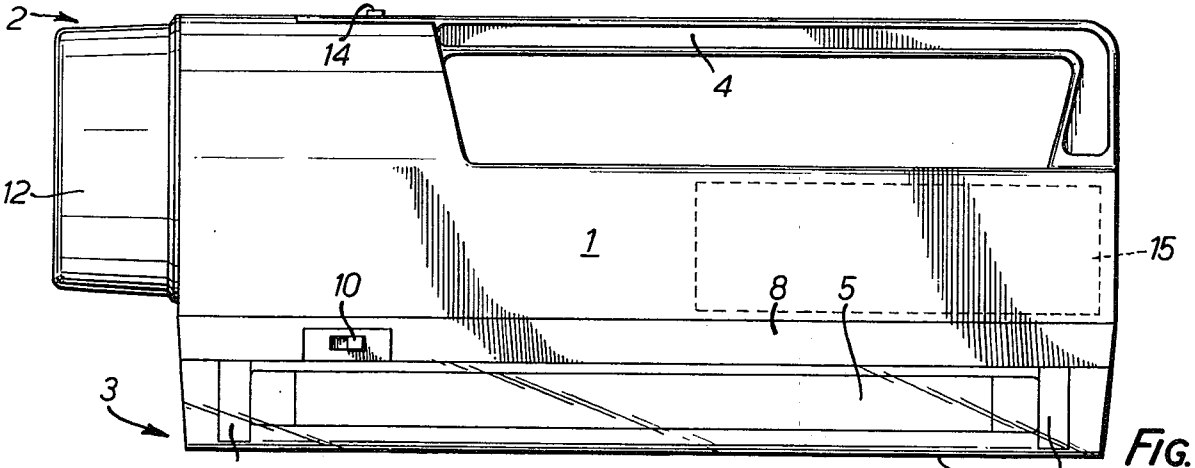
Figure 2:
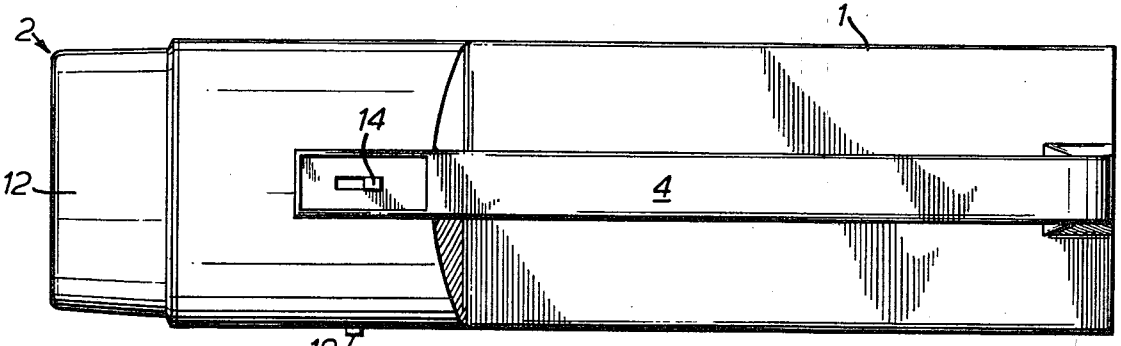
FIG. 2 is a plan view of the torch of FIG. 1.
Figure 3:
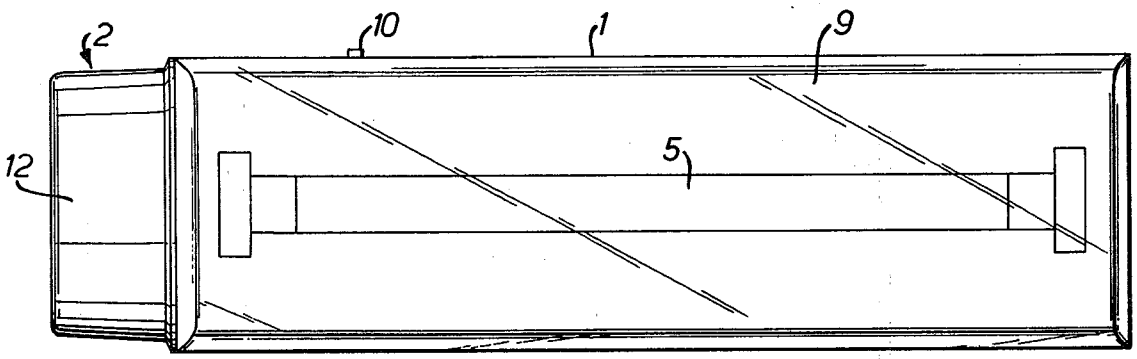
FIG. 3 is a view from underneath the torch of FIG. 1.

The torch comprises a body 1 defining a case for a replaceable battery 15 and on which is slidably mounted a spot light and flashing light assembly 2, and to which a fluorescent light assembly 3 is detachably secured. A handle 4 is formed with the body 1 so that the torch may be readily carried.

The fluorescent light assembly 3 comprises a fluorescent tube 5 mounted between connections 6 and 7, which are secured to a base 8. The tube is protected by a transparent cover 9 secured to the base 8. The base 8 has an ON/OFF switch 10 for the light and is detachably secured to the body 1 by means (not shown).

Figure 4:
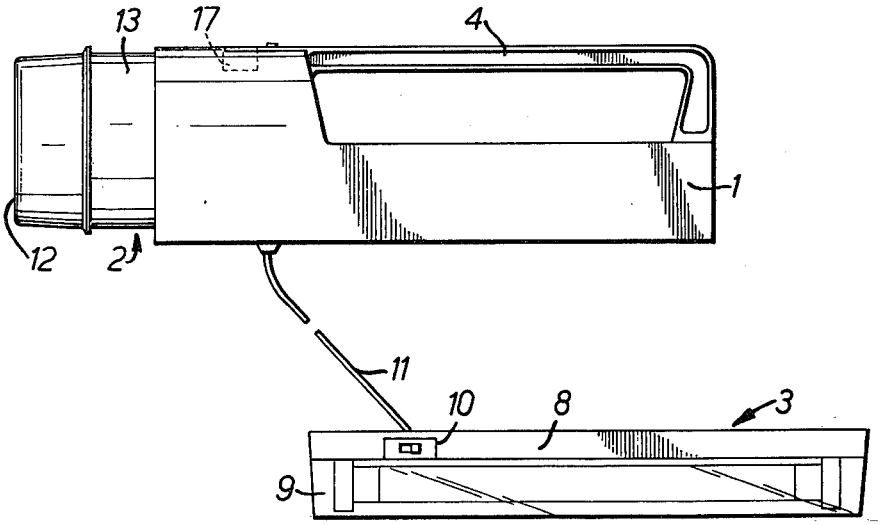
FIG. 4 is a side elevation to a reduced scale of the torch with a fluorescent light assembly detached and a flashing light exposed.
Figure 5:
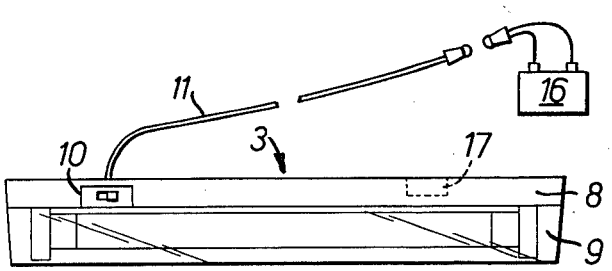
FIG. 5 shows the fluorescent light assembly disconnected from the main body.

The fluorescent light assembly 3 may be detached from the body 1 but still remain connected to the battery in the body by a lead 11, as shown in FIG. 4. The lead 11 can also be unplugged from a socket on the body, as shown in FIG. 5, so that the light can be connected to an alternative power source such as a car battery 16.

The flashing light assembly 2 comprises a spotlight 12 and a flashing light 13, as shown in FIG. 4. The assembly is slidably mounted in the body 1 to be capable of being moved between the position shown in FIG. 4, with the flashing light 13 exposed, and the position shown in FIG. 1 with the flashing light within the body 1.

The operation of the spotlight 12 is controlled by a switch 14 which may also control the flashing light 13. Alternatively the flashing light 13 may be arranged such that it is automatically "ON" when in the exposed position and "OFF" when covered by the body.

The fluorescent tube 5 requires an inverter circuit 17, if it is to be supplied with the necessary A.C. from a battery. The inverter circuit 17 may be included within the body 1, as shown in FIG. 4, or more conveniently the inverter circuit 17 is included within the base 8 as shown in FIG. 5, so that it will still be available when the fluorescent light fitting 3 is connected to the car battery 16.

It will be appreciated that the torch is particularly suitable for use by the owner of a motor car. The fixed or spotlight in the fitting 2 can be used, for example, for map reading, or generally as a conventional torch, while the flashing light can be used to give a warning, for example, if the car has broken down. The fluorescent light would be convenient, for example, for examining under the bonnet in the case of an engine failure, and for that purpose it can be detached from the main body and perhaps held, or suspended within the engine compartment. It will of course be lighter and smaller than the complete torch. In that position, it can be supplied from the car battery. Alternatively, it could be used as a reading lamp by a motorist who has stopped driving for the day, and is camping.

We claim:

1. A portable torch comprising a body defining a battery case, a first light fitting detachably mounted on the body, a flexible lead connected between the first light fitting and the body, and a second light fitting permanently mounted on the body, said torch including means for causing a first lamp in the second light fitting to flash on and off, said second light fitting being slidably mounted on the body between a first position in which the lamp is concealed by the body, and a second position in which the lamp is exposed, said second light fitting including a second lamp which remains exposed from the body when said second light fitting is in either of said first and said second positions.

2. A portable torch as claimed in claim 1 in which the body incorporates a carrying handle.

3. A portable torch as claimed in claim 1 or claim 2 including a switch for said first and second light fittings.

4. A portable torch as claimed in claim 1 including a fluorescent lamp mounted in said first light fitting.

5. A portable torch as claimed in claim 4 including an inverter for providing the fluorescent lamp with an A.C. supply from a battery.

6. A portable torch as claimed in claim 1 including means for enabling said flexible lead to be disconnected from said body and connected to a power supply other than a battery in the battery case.

7. A portable torch as claimed in claim 6 in which a car battery is the power supply other than the battery in the battery case.

8. A portable torch comprising a body defining a battery case, a first light fitting detachably mounted on the body, and a flexible lead connected between the first light fitting and the body, wherein a second light fitting is permanently mounted on the body.

9. A portable torch as claimed in claim 8 including flashing means for causing a lamp in the second light fitting to flash on and off.

10. A portable torch as claimed in claim 9 in which the second light fitting is slidably mounted on the body between a first position in which the lamp is concealed by the body and a second position in which the lamp is exposed.

11. A portable torch as claimed in claim 9 including a switch which switches off the lamp in the second light fitting when it is in said first position.

12. A portable torch comprising a plastic casing, a battery, a first light fitting including a fluorescent lamp, a second light fitting including an incandescent lamp and a flashing lamp and a flexible lead in which said battery is retained within said plastic casing;

said first light fitting being detachably mounted on said plastic casing, said flexible lead connecting said fluorescent lamp to said battery such that said fluorescent lamp may remain connected to said battery both when said first light fitting is mounted on said plastic casing and when said first light fitting is detached from said plastic casing, said first light fitting including a fluorescent lamp switch;

said second light fitting being slidably mounted on said plastic casing and being movable between a first position in which said flashing lamp is concealed by said plastic casing and a second position in which said flashing lamp is exposed, said incandescent lamp remaining exposed when said second light fitting is in said first position and in said second position;

said portable torch including switch means, said switch means switching off said flashing flamp when said second light fitting is in said first position.

* * * * *